US009470365B1

(12) United States Patent
Atkinson et al.

(10) Patent No.: US 9,470,365 B1
(45) Date of Patent: Oct. 18, 2016

(54) APPARATUS, METHODS, AND SYSTEMS FOR STORING AND MANAGING LIQUIDS IN AN OFFSHORE ENVIRONMENT

(71) Applicants: Robert Brian Atkinson, Houston, TX (US); Gregory Arthur Winslow, Houston, TX (US); Dengen Zhou, Sugar Land, TX (US)

(72) Inventors: Robert Brian Atkinson, Houston, TX (US); Gregory Arthur Winslow, Houston, TX (US); Dengen Zhou, Sugar Land, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/797,919

(22) Filed: Jul. 13, 2015

(51) Int. Cl.
*B65D 88/78* (2006.01)
*F17C 1/00* (2006.01)
(Continued)

(52) U.S. Cl.
CPC ..... *F17C 1/007* (2013.01); *B65D 88/78* (2013.01); *F17C 1/02* (2013.01); *F17C 5/00* (2013.01); *F17C 7/00* (2013.01); *F17C 13/02* (2013.01); *F17C 2203/011* (2013.01);
(Continued)

(58) Field of Classification Search
CPC ..... B65D 88/78; B65D 2590/046
USPC ..... 405/210
See application file for complete search history.

(56) References Cited

U.S. PATENT DOCUMENTS 3,067,712 A * 12/1962 Doerpinghaus ..... B63B 35/285 114/246
3,111,371 A * 11/1963 Bull ..... B65D 90/046 216/58

(Continued)

FOREIGN PATENT DOCUMENTS

GB 2499804 * 9/2013
JP 57071936 A * 5/1982

(Continued)

OTHER PUBLICATIONS

OTC 24537; Flexible Subsea Storage Unit—Development and Applications; A.R. Kristoffersen, J.P. Kaalstad, Kongsberg Oil and Gas; Offshore Technology Conference, 2013.

(Continued)

*Primary Examiner* — Frederick L Lagman
(74) *Attorney, Agent, or Firm* — Karen R. DiDomenicis

(57) ABSTRACT

A storage tank for storing liquids on the seafloor in a subsea environment is disclosed. The storage tank includes a protective enclosure having a removable cover. The storage tank has at least one compartment therein within which is a container including an outer flexible bladder and an inner flexible bladder within the outer flexible bladder. The inner flexible bladder is capable of containing an inner liquid. The space between the inner flexible bladder and the outer flexible bladder is capable of containing an outer liquid. The inner flexible bladder has a liquid inlet capable of connecting to a source of the inner liquid. The inner flexible bladder has a liquid outlet capable of connecting to a line for conveying the inner liquid to a desired location. The storage tank further includes a recirculation loop for circulating the outer liquid in the space between the inner flexible bladder and the outer flexible bladder. A system for managing liquids in an offshore environment is disclosed, the system using the storage tank, a first conduit connected to the inner flexible bladder liquid inlet of the storage tank for supplying the inner liquid from a topside location, a second conduit connected to the inner flexible bladder liquid outlet, and a pump connected to the second conduit for pumping the inner liquid to a desired pressure for conveying the inner liquid to a desired location.

23 Claims, 5 Drawing Sheets

(51) Int. Cl.

| | |
|---|---|
| ***F17C 1/02*** | (2006.01) |
| ***F17C 13/02*** | (2006.01) |
| ***F17C 7/00*** | (2006.01) |
| ***F17C 5/00*** | (2006.01) |

(52) U.S. Cl.
CPC ..... *F17C 2205/0103* (2013.01); *F17C 2205/0184* (2013.01); *F17C 2209/22* (2013.01); *F17C 2270/0128* (2013.01)

(56) References Cited

U.S. PATENT DOCUMENTS

| | | | | | |
|---|---|---|---|---|---|
| 3,126,559 | A * | 3/1964 | Alexander | B65D 88/78 | 367/133 |
| 3,425,791 | A * | 2/1969 | Koberg | B01J 19/16 | 222/54 |
| 3,518,836 | A * | 7/1970 | Itokawa | B65D 88/78 | 405/210 |
| 3,727,418 | A * | 4/1973 | Glazier | F17C 3/005 | 114/257 |
| 3,837,310 | A * | 9/1974 | Toyama | B65D 88/78 | 114/257 |
| 4,007,700 | A * | 2/1977 | Haynes | B63B 35/28 | 114/74 T |
| 4,011,736 | A * | 3/1977 | Harrison | F25D 1/00 | 165/10 |
| 4,141,377 | A * | 2/1979 | Fernandez | B65D 88/62 | 137/236.1 |
| 4,190,072 | A * | 2/1980 | Fernandez | B65D 88/62 | 137/236.1 |
| 4,662,386 | A * | 5/1987 | Pedersen | B65D 88/78 | 137/236.1 |
| 6,945,187 | B1 * | 9/2005 | Woodall | B63B 35/285 | 114/244 |
| 7,448,404 | B2 * | 11/2008 | Samuelsen | B65D 88/78 | 137/236.1 |
| 7,841,289 | B1 * | 11/2010 | Schanz | B63B 25/08 | 114/256 |
| 8,678,711 | B2 * | 3/2014 | Wu | B63B 35/44 | 405/210 |
| 2014/0133922 | A1 | 5/2014 | Hantz | | |
| 2014/0301790 | A1 | 10/2014 | Chitwood | | |
| 2014/0341657 | A1 * | 11/2014 | Chitwood | B65D 27/08 | 405/205 |
| 2015/0108159 | A1 | 4/2015 | Roller et al. | | |
| 2016/0023843 | A1 * | 1/2016 | Donahue | B65D 88/78 | 405/210 |

FOREIGN PATENT DOCUMENTS

| | | | | |
|---|---|---|---|---|
| WO | WO 2011084164 | A1 * | 7/2011 | B65D 88/78 |
| WO | WO 2014077820 | A1 * | 5/2014 | B65D 88/78 |

OTHER PUBLICATIONS

OTC-25526-MS; Deepwater Arctic Subsea Separation & Storage Systems; Rolf Eie, Kvaerner Concrete Solutions AS; Offshore Technology Conference, 2015.

* cited by examiner

APPARATUS, METHODS, AND SYSTEMS FOR STORING AND MANAGING LIQUIDS IN AN OFFSHORE ENVIRONMENT

FIELD

The present disclosure relates to tanks for storing liquids in a subsea environment. The present disclosure further relates to systems and methods for storing and managing liquids in a subsea environment using the tanks.

BACKGROUND

There is an increasing need for storage of liquids in a subsea environment, particularly in the field of offshore oil and gas production. For example, liquid chemicals are used for enhanced oil recovery in which liquid chemicals are injected into subterranean hydrocarbon producing reservoirs to facilitate increased production of hydrocarbons from the reservoirs. In order for chemical injection operations to be most cost-effective, chemicals are needed to be stored on the seafloor in the vicinity of the subterranean hydrocarbon reservoirs.

For continuous or semi-continuous chemical injection for enhanced oil recovery to be possible, it is desirable that at least several days of chemical storage be provided. This could equate to very large storage volumes in order to match the injection rates. The majority of offshore oil and gas production existing facilities cannot accommodate such volumes. Offshore platforms cannot accommodate the space nor the weight associated with storage of such volumes. The installation of pipelines to transport the chemicals from shore is often not economically practical and in some areas can present environmental challenges. Floating production, storage and offloading (FPSO) vessels are another alternative means to supply the chemicals, but they are expensive to operate and can be sensitive to weather and ocean conditions.

There exists a need for apparatus, systems and methods for storing and managing liquids onsite in a subsea environment which address the aforementioned challenges in a cost effective, practical way.

SUMMARY

In one aspect, a storage tank for storing liquids in a subsea environment is provided. The storage tank includes a protective enclosure for positioning on a seafloor. The protective enclosure includes at least one compartment therein and a removable cover. Within each compartment is a container including an outer flexible bladder and an inner flexible bladder within the outer flexible bladder. The inner flexible bladder is capable of containing an inner liquid, and a space is provided between the inner flexible bladder and the outer flexible bladder capable of containing an outer liquid. The inner flexible bladder has a liquid inlet capable of connecting a source of the inner liquid to the inner flexible bladder. The inner flexible bladder has a liquid outlet capable of connecting the inner flexible bladder to an inner liquid line external to the protective enclosure. The storage tank further includes a recirculation loop including a pump for circulating the outer liquid in the space between the inner flexible bladder and the outer flexible bladder.

In another aspect, a system for managing liquids in an offshore environment is provided. The system includes a storage tank as described herein, a first conduit connected to the inner flexible bladder liquid inlet of the storage tank for supplying the inner liquid from a topside location to the inner flexible bladder, a second conduit connected to the inner flexible bladder liquid outlet, and a pump connected to the second conduit for pumping the inner liquid to a desired pressure for conveying the inner liquid within a pipeline to a desired location.

In another aspect, a method for managing liquids in an offshore environment is provided. The method includes supplying a first liquid to the inner flexible bladder of a storage tank as described herein located on a seafloor, supplying a second liquid to the outer flexible bladder of the storage tank for storage in the space between the inner flexible bladder and the outer flexible bladder, flowing the first liquid through the inner flexible bladder liquid outlet to a conduit external to the protective enclosure of the storage tank for delivery to a desired subsea location, and circulating the second liquid in the space between the inner flexible bladder and the outer flexible bladder by operating a pump in the line between the outer flexible bladder liquid inlet and the outer flexible bladder liquid outlet.

DESCRIPTION OF THE DRAWINGS

These and other objects, features and advantages of the present invention will become better understood with reference to the following description, appended claims and accompanying drawings where:

DETAILED DESCRIPTION

Figure 1:
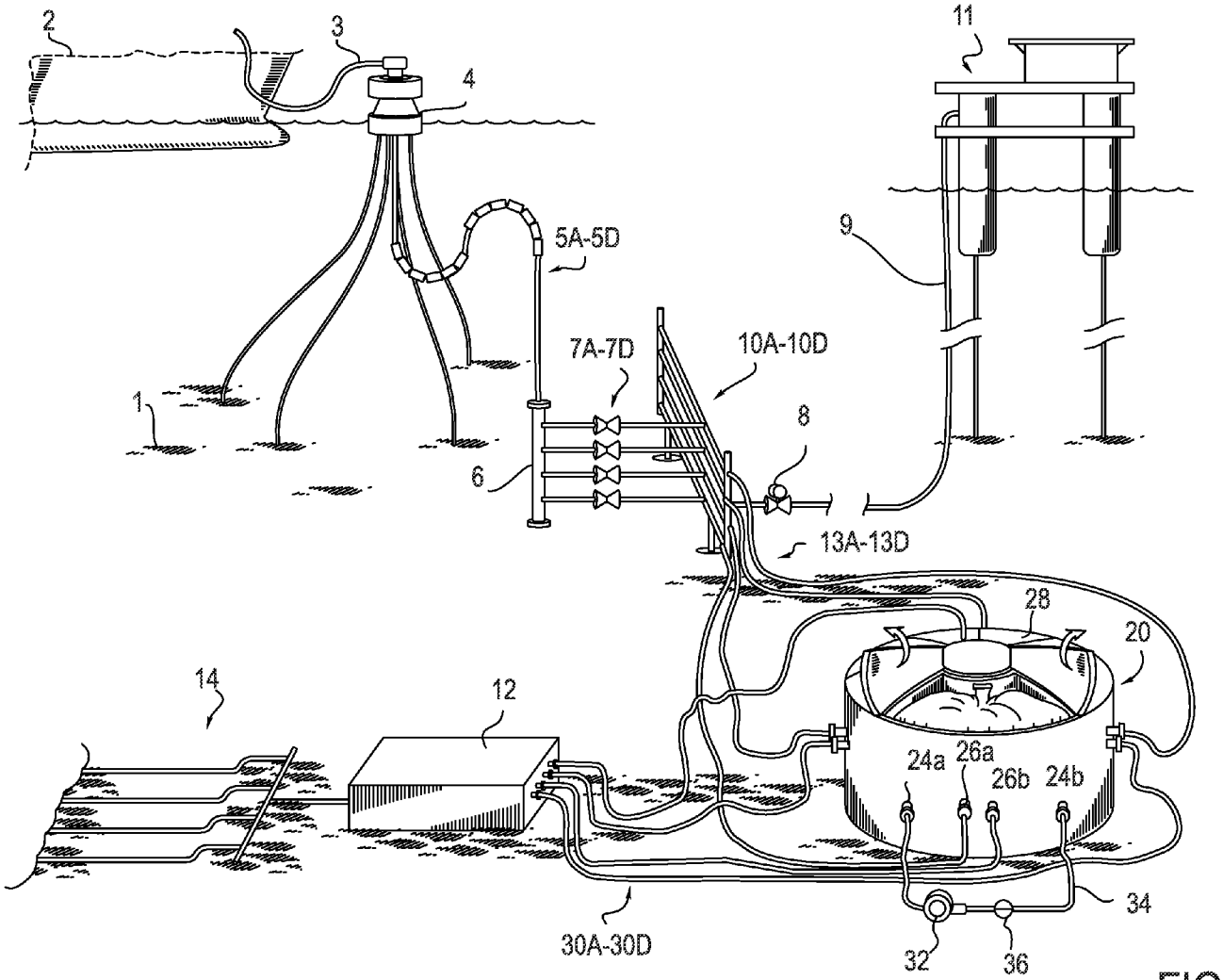
FIG. 1 is a simplified diagram illustrating a system for storing and managing liquids in a subsea environment according to one exemplary embodiment.

FIG. 1 illustrates one embodiment of a system for storing and managing liquids in a subsea environment. As shown in FIG. 1, a subsea manifold 6 is located on a seafloor 1. The subsea manifold 6 includes a number of conduits capable of receiving liquids from one or more lines. In the nonlimiting system shown, the manifold 6 can receive up to four different liquids from multiple lines 5A-5D. These lines 5A-5D can either be in the form of separate risers or combined in a multi-line umbilical riser (as shown) depending on budget and need for flexibility. The liquids are transferred from a floating vessel 2 to a turret buoy 4 via line 3. Alternatively, the vessel can be safely moored in a location for filling. An alternate buoy connection or a freestanding riser can be secured on site using a catenary anchor system. Such system is equipped with an internal means for connecting risers and hoses. The liquids can be transferred from the vessel 2 to alternate buoy connection or a freestanding riser and to subsea manifold 6 via lines 5A-5D. In an alternative embodiment, rather than the liquid(s) supplied from a floating vessel 2, the liquid(s) can be supplied from a floating platform (not shown).

As shown in FIG. 1, the subsea manifold 6 includes four valves 7A-7D controlling flow of each of the liquids separately to lines 10A-10D. From the manifold 6, lines 13A-13D, also referred to as conduits 13A-13D, are used to deliver the liquids to separate compartments within a storage tank 20 located on the seafloor 1.

In one embodiment, the chemicals delivered to the subsea manifold 6 are in the form of concentrated liquid chemicals, and water is introduced to the subsea manifold 6 to dilute the concentrated chemicals to achieve a desired concentration prior to storing the chemicals in the storage tank 20. The system can include an optional platform 11 having a water storage tank thereon and a line 9 for supplying water from the platform 11 to the subsea manifold 6. A valve 8 can be provided in the line 9 for controlling the flow of the water. In another embodiment, water is pre-mixed with the liquid chemicals on the floating vessel 2 (or platform). In another embodiment, the chemicals are stored in the storage tank 20 in their concentrated form, and are diluted downstream of the storage tank 20 and prior to the well heads (not shown).

Figure 2:
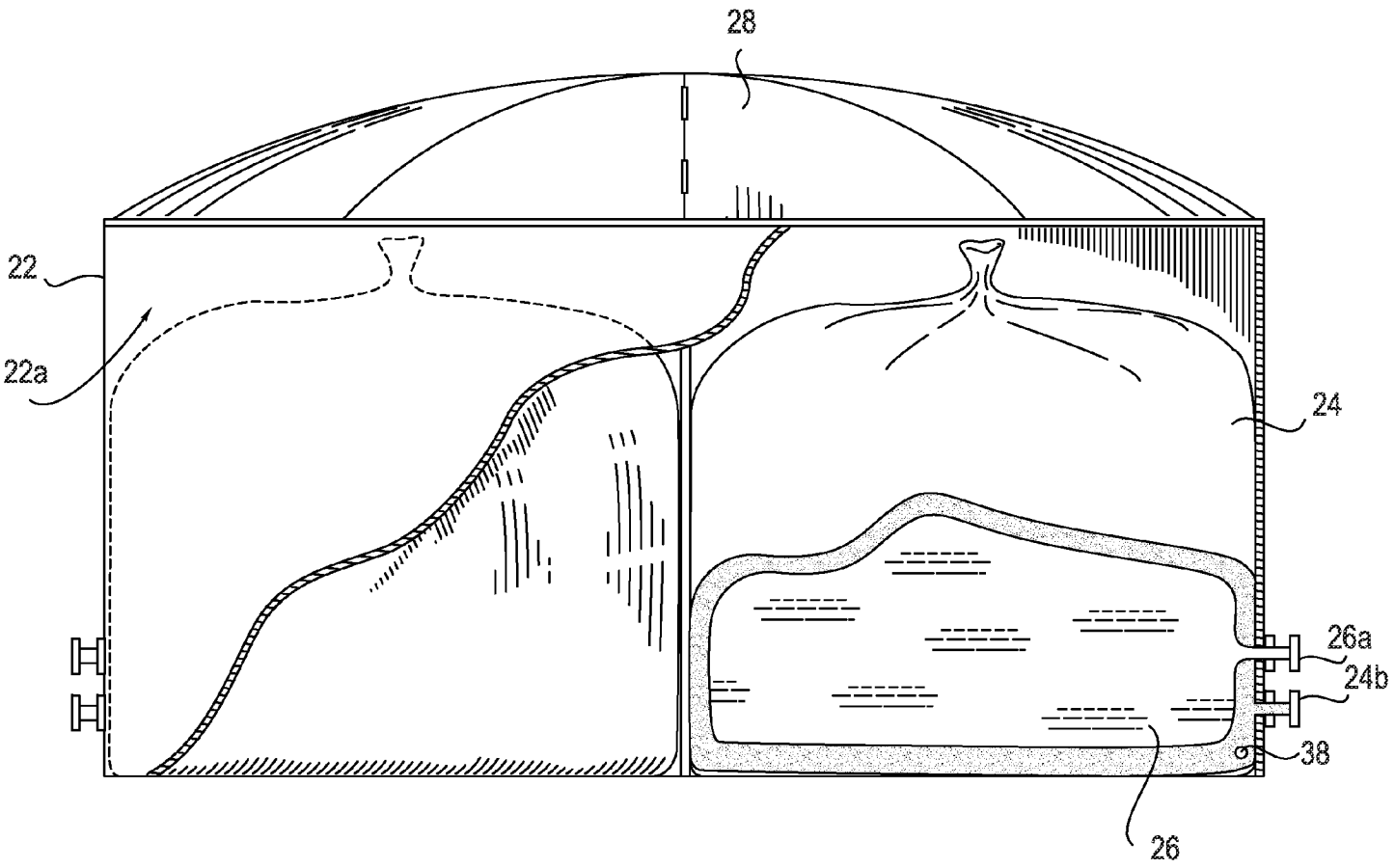
FIG. 2 is a simplified diagram illustrating a storage tank for storing liquids according to one exemplary embodiment.

FIG. 2 illustrates one embodiment of the storage tank 20 used in the systems and methods of the disclosure. The storage tank 20 consists of an inner flexible bladder 26, also referred to as an inner bladder 26, located within an outer flexible bladder 24, also referred to as an outer bladder 24. The inner bladder 26 within the outer bladder 24 is also referred to as the container 26/24.

A protective enclosure 22 surrounds the container 26/24. The protective enclosure 22 is divided up into compartments 22A, such that there is one compartment 22A for each container 26/24. Thus a plurality of liquids can be separately stored in the storage tank 20. The number of compartments 22A in the storage tank 20 corresponds to the number of conduits in the subsea manifold, with each inner bladder 26 in its corresponding compartment 22A being supplied by a dedicated conduit in the subsea manifold 6, which is in turn supplied by a topside location 2.

Figures 3A, 3B:
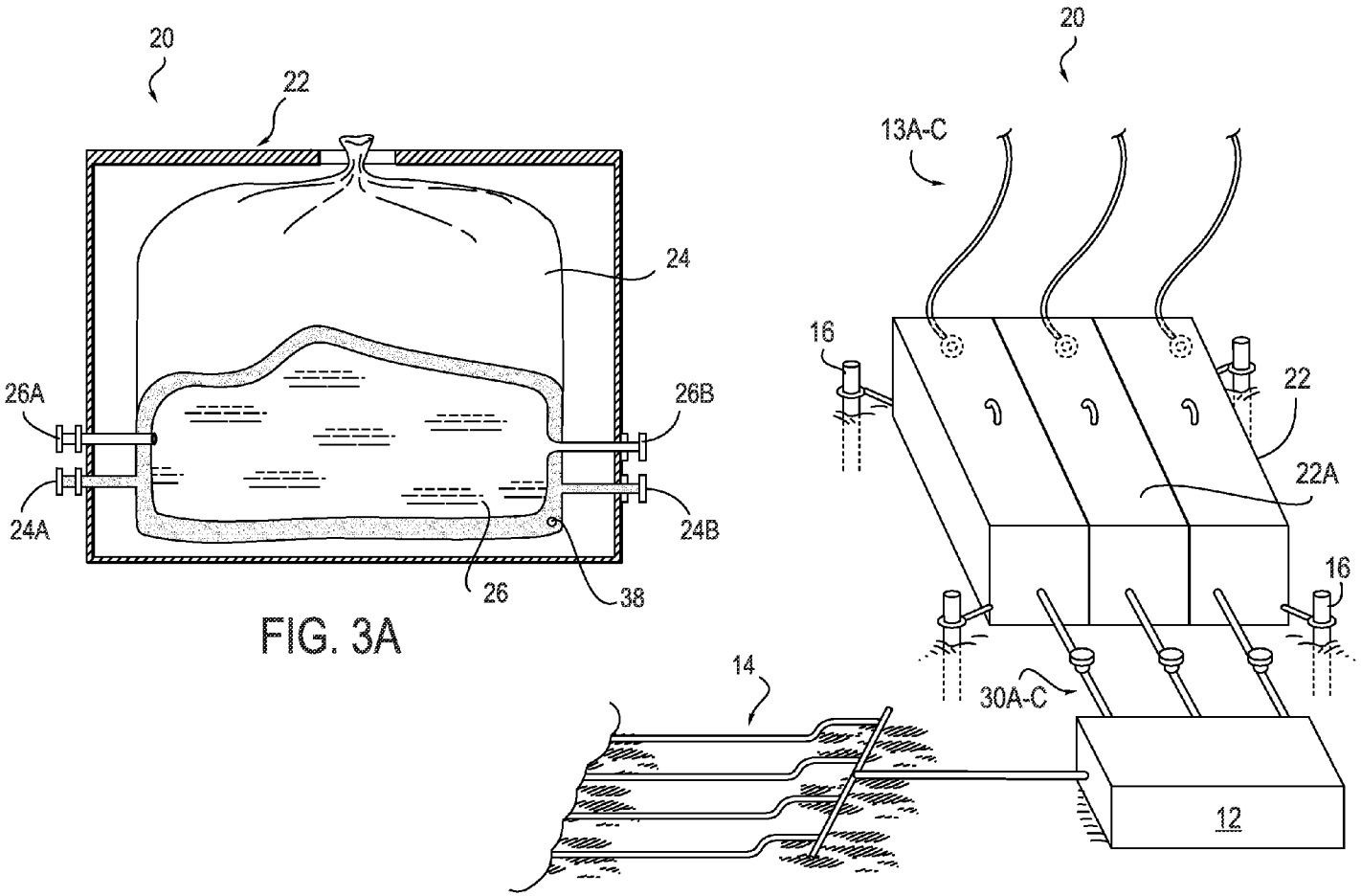
FIG. 3A is a simplified diagram illustrating a storage tank for storing liquids according to another exemplary embodiment.
FIG. 3B is a simplified diagram illustrating a portion of a system for storing and managing liquids in a subsea environment according to an exemplary embodiment.

FIGS. 3A and 3B illustrate an alternative shape of the storage tank 20, in this embodiment rectangular versus round as in FIGS. 1 and 2.

The protective enclosure 22 can be formed of any suitable material selected from, but not limited to, fiberglass-reinforced epoxy, carbon fiber, steel, concrete and combinations thereof. In one embodiment, the protective enclosure 22 can be a partially open structure such as a steel cage, a concrete frame, a mesh cage or a combination thereof. The protective enclosure 22 has an internal pressure and an external pressure. In one embodiment, the protective enclosure 22 is configured to allow for equalization of the internal and external pressures to minimize structural strength required in the protective enclosure 22.

The protective enclosure 22 also has a removable cover 28. In one embodiment, the removable cover 28 is a hinged hatch or door as in FIG. 2 and FIG. 5C. The removable cover 28 can have a plurality of removable cover segments. The use of removable cover segments can reduce the weight of removable cover 28 to allow for opening the removable cover 28 using ROVs, winches or other equipment that would eliminate need for heavy lifting equipment on site. The removable cover segments can take the form of "manhole covers" in the protective enclosure 22 as in FIG. 5A. The removable cover 28 can be formed of any suitable material selected from, but not limited to, fiberglass-reinforced epoxy, carbon fiber, steel and combinations thereof.

In one embodiment, a method for installing the storage tank 20 is provided. Protective enclosure 22 can be floated to the desired location. Alternatively, the component parts of the protective enclosure 22 can be delivered to the subsea location and assembled on-site. The protective enclosure 22 can be secured to the seafloor 1 by any suitable securing mechanism. FIG. 3B illustrates the use of suction piles 16, as would be apparent to one of skill in the art. Other securing mechanisms can be used, including steel skirt piles and concrete anchor blocks (not shown) using known subsea securing methods.

Figure 4:
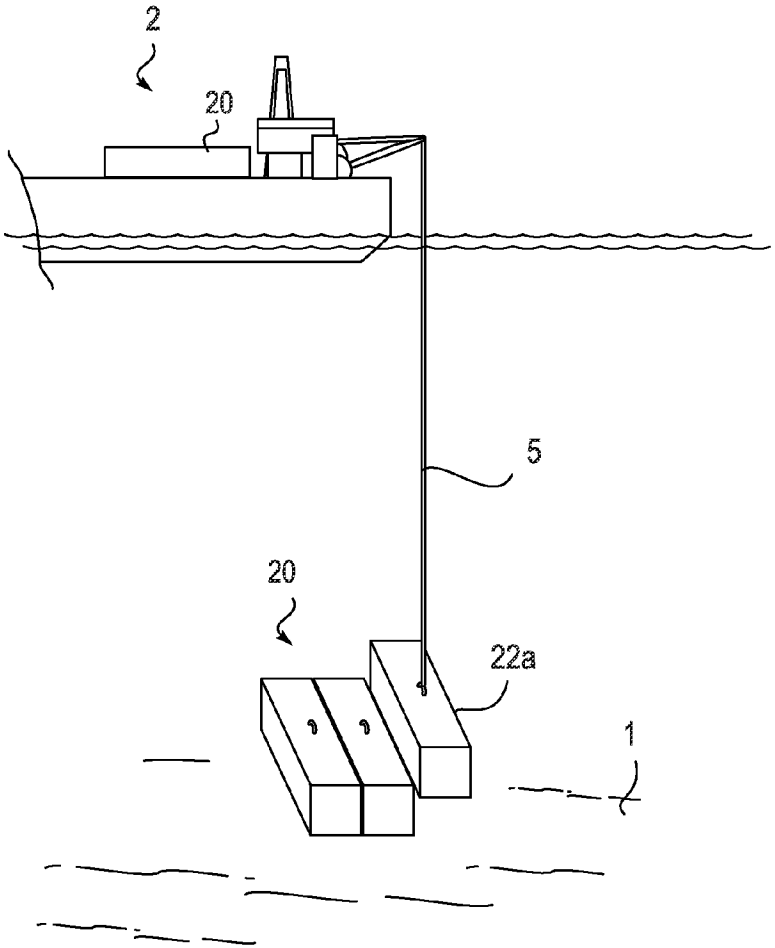
FIG. 4 is a simplified diagram illustrating a method for installing a storage tank according to one exemplary embodiment.

FIG. 4 is a simplified diagram illustrating a method for lowering the storage tank 20 from vessel 2. Each compartment 22A can be lowered using a cable 5.

With the removable cover 28 removed such that the top of the protective enclosure 22 is open, each container 26/24 can then be inserted into its respective compartment 22A. First each container 26/24 can be transported offshore and lowered onto the water surface using a suitable support such as cargo netting capable of supporting the dry weight of the container 26/24. In some embodiments, once in the water, gas is added to the container, either to the inner bladder 26 and/or the outer bladder 24, to reduce the weight of the container to a manageable level for lowering to the seafloor. The container is then guided to the seafloor 1 using cable guides while lowering the container into the protective enclosure 22. Optionally, the cargo netting is left in place for future maintenance or replacement operations.

Each inner bladder 26 is capable of containing a liquid, also referred to herein as an "inner liquid," and a space is provided between the inner bladder 26 and its corresponding outer bladder 24. The space between the inner bladder 26 and the outer bladder 24 is capable of containing a liquid, also referred to herein as an "outer liquid." The inner bladder 26 has a liquid inlet 26A capable of connecting a source of the inner liquid to the inner bladder 26. The source of the inner liquid can be, e.g., one of the lines 13A-13D. The inner bladder 26 has a liquid outlet 26B capable of connecting the inner bladder 26 to an inner liquid line external to the protective enclosure 22. The liquid inlet 26A and the liquid outlet 26B can be positioned to minimize risk of premature fatigue during inflating and deflating. FIG. 1 illustrates an example using four different liquid chemicals, thus there are four separate inner liquid lines or conduits 30A-30D shown. The liquid from the inner bladder 26 can flow through the liquid outlet (also referred to herein as the inner flexible bladder liquid outlet) 26B to one of the conduits or lines 30A-30D for delivery to a desired subsea location, such as to a hydrocarbon producing reservoir (not shown) via pumping module 12, also referred to herein as a subsea injection pumping and distribution module. Such modules can include one or more low shear pumps, such as progressive cavity, twin screw, or double piston displacement pumps, sized and provided in an appropriate number to accommodate the desired number of injection wells. Power can be supplied from electrical cables from topside facilities or hydraulic power supply units. Subsea connection lines 14 can connect the subsea injection pumping and distribution module to each chemical injection well (not shown).

Each inner bladder 26 and the corresponding outer bladder 24 can be formed of the same or differing materials as appropriate for the specific application. The material has sufficient flexibility to allow for expansion when the bladders are filled with liquid or partially inflated with gas. Furthermore, the bladders will contract or deflate as a result of hydrostatic pressure applied by the surrounding seawater during use. The material is non-porous and impervious to deterioration caused by leaching when exposed to surfactants, co-solvents and polymers. In one embodiment, the outer bladder 24 is formed of a material that is strong, durable and has high puncture resistance and chemical resistance. For example, such material can include aramid fibers, graphene sheets or layers of sheets, nitrile rubber, neoprene, poly(vinyl chloride), polyurethane and combinations thereof. The inner bladder 26 can also be formed of such material although the material may not have to be as high in mechanical damage resistance. For example, such material can include polyurethane and nitrile rubber.

Each outer bladder 24 has an inner surface and the inner bladder 26 has an outer surface. In one embodiment, the inner surface of the outer bladder 24 has a plurality of protrusions (not shown) thereon. Alternatively, the outer surface of the inner bladder 26 has a plurality of protrusions thereon. In either case, the plurality of protrusions provides a space between the outer surface of the inner bladder 26 and the inner surface of the outer bladder 24. The protrusions can be in the form of raised nodules or ribs. The space is provided to allow room for the outer fluid to circulate around the inner bladder 26.

The outer fluid contained between the inner bladder 26 and the outer bladder 24 can either be pre-loaded during installation of the storage tank 20 or could be pumped in by pumping means after installation of the storage tank 20. The outer fluid volume is relatively small in comparison to the volume of the inner fluid and is preferably in a closed system.

In one embodiment, the storage tank 20 further includes a recirculation loop including a pump 32 for circulating the outer liquid in the space between the inner bladder 26 and the outer bladder 24. The pump 32 can be in an outer liquid line 34 external to the protective enclosure 22 connected to the space between the inner bladder 26 and the outer bladder 24. The line 34 is connected to an outer bladder liquid inlet 24A and an outer bladder liquid outlet 24B, located at positions spaced a distance apart, sufficient to circulate the outer fluid within the space. In one embodiment, the outer bladder liquid inlet 24A and the outer bladder liquid outlet 24B are connected to the outer bladder 24 at from about 10 cm to about 15 cm apart.

In one embodiment, within the line 34 is a monitoring device 36 for monitoring changes in the outer fluid as it is being circulated. For example, a dye can be included in the inner liquid. In the event that there is a leak of the inner bladder 26, the dye would move into the outer liquid and could be detectable by the monitoring device 36. In this example, the monitoring device 36 could be a sight glass providing visual contact with the outer liquid. The dye can be detected by ROV inspection.

In one embodiment, an optional sensor 38 can be located in the space between the inner bladder 26 and the outer bladder 24 for detecting the inner liquid in the space between the inner and the outer bladders. The sensor 38 can be capable of measuring changes in resistivity or gravity of the outer liquid.

In one embodiment, the inner bladder 26 has a rupture disc (not shown) therein having a design failure pressure such that when the pressure within the inner bladder 26 reaches the design failure pressure, the inner liquid will flow into the space between the inner bladder 26 and the outer bladder 24.

In some embodiments, during the filling of the inner bladder 26, the inner liquid, also referred to as the first liquid, is pumped into the inner bladder 26 from a topside location using a pump (not shown) while monitoring the discharge pressure on the pump. The discharge pressure on the pump can be controlled to avoid overfilling the inner bladder 26.

Figure 5B:
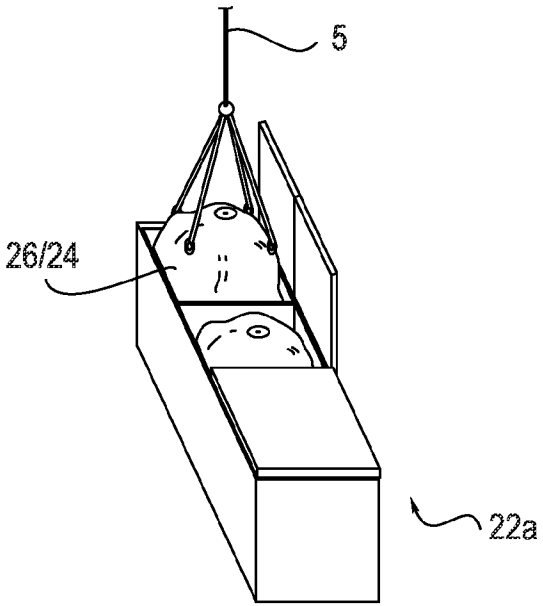
FIGS. 5A-5B are simplified diagrams illustrating alternative methods for accessing and removing a container from a storage tank according to other exemplary embodiments.
Figure 5A:
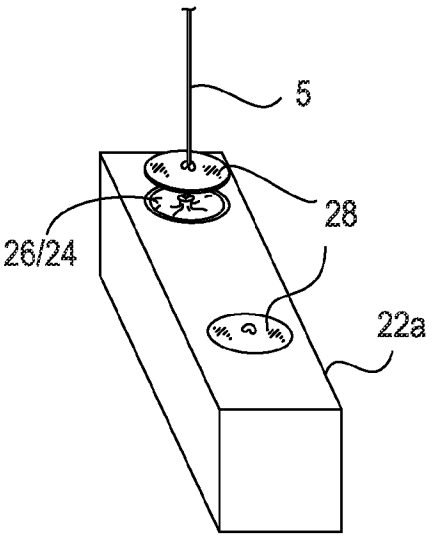

In some applications, it may be desirable to remove the container 26/24 from within each of the compartments 22A. This may be done on a routine maintenance schedule at some desired frequency or as needed for repairs. FIG. 5B illustrates one method for removing a container 26/24 from a storage tank compartment 22A according to an exemplary embodiment. In some embodiments, prior to removing the container 26/24, the inner bladder 26 and/or the outer bladder 24 can be partially inflated by injecting gas into the inner and/or outer bladder to impart buoyancy to facilitate lifting of the container 26/24 by reducing the lifting force required. The container 26/24 can be attached to lifting equipment by a cable 5, such as but not limited to, cranes or winch mechanisms, on a vessel or platform. A plurality of connection points on the outer bladder 24 can be provided where attachment can be made to lifting equipment. Alternatively, a sling or net can be provided around the outer bladder 24 which can be attached to lifting equipment. In addition to utilizing these methods to remove the container 26/24, they may also be used to raise the container 26/24 for inspection.

Storage tanks, systems and methods as described herein can be used to store and manage various liquids and chemicals used in subsea oil and gas production facilities. Such liquids include, but are not limited to, surfactants, alkali, polymers, water, and the like. Each liquid is stored in a separate inner bladder 26 of a container 26/24.

Storage tanks, systems and methods as described herein advantageously provide the ability to store large volumes of liquid chemicals on the seafloor. Leaks can easily be contained and detected in the event of a leak from the inner bladder. Liquid chemicals can be stored in removable containers to simplify installation, maintenance and removal of the containers. Having a storage tank secured to the seafloor minimizes problems associated with weight loading, area usage and potential risk to personnel. Storage of large volumes on site can reduce operating costs and risk associated with multiple chemicals delivery trips by marine transportation. The systems disclosed herein can also be applied to deepwater subsea processes including but not limited to well stimulation systems, oil export facilities, and the like.

In one embodiment, the storage tank 20 may be equipped with a circulation system to keep the chemicals stored therein mixed and/or agitated to prevent segregation or precipitation over time, since some chemicals may require some mixing for long-term storage. This can be accomplished by adding a recirculation system that would recirculate product in the inner bladder 26 at a high enough rate to keep the product sufficiently mixed. Connections from the subsea injection pump modules can be tied into the manifold 6 to accommodate this; alternatively, a set of low volume, low pressure pumps (not shown) can be installed.

It should be noted that only the components relevant to the disclosure are shown in the figures, and that many other components normally part of a subsea liquid management system are not shown for simplicity.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A storage tank for storing liquids in a subsea environment, comprising:

a. a protective enclosure for positioning on a seafloor wherein the protective enclosure comprises at least one compartment therein and a removable cover;

b. a container within each of the at least one compartment of the protective enclosure wherein each container comprises an outer flexible bladder and an inner flexible bladder positioned within and spaced a distance from the outer flexible bladder; such that the inner flexible bladder is capable of containing an inner liquid and a space is provided between the inner flexible bladder and the outer flexible bladder capable of containing an outer liquid;

c. an inner flexible bladder liquid inlet capable of connecting a source of the inner liquid to the inner flexible bladder;

d. an inner flexible bladder liquid outlet capable of connecting the inner flexible bladder to an inner liquid line external to the protective enclosure; and e. a recirculation loop for circulating the outer liquid in the space between the inner flexible bladder in the outer flexible bladder, comprising:

i. an outer liquid line external to the protective enclosure having an outer flexible bladder liquid inlet and an outer flexible bladder liquid outlet; and ii. a pump located in the outer liquid line between the outer flexible bladder liquid inlet and the outer flexible bladder liquid outlet for circulating the outer liquid from the outer flexible bladder liquid outlet to the outer flexible bladder liquid inlet.

2. The storage tank of claim 1 wherein the outer flexible bladder liquid inlet and the outer flexible bladder liquid outlet are connected to the outer flexible bladder at from about 10 cm to about 15 cm apart.

3. The storage tank of claim 1 wherein the inner flexible bladder comprises a material selected from the group consisting of polyurethane and nitrile rubber.

4. The storage tank of claim 1 wherein the outer flexible bladder comprises a material selected from the group consisting of aramid fibers, graphene sheet, nitrile rubber, neoprene, poly(vinyl chloride), polyurethane and combinations thereof.

5. The storage tank of claim 1 wherein the outer flexible bladder has an inner surface and the inner flexible bladder has an outer surface; wherein the inner surface of the outer flexible bladder or the outer surface of the inner flexible bladder comprises a plurality of protrusions to provide space between the outer surface of the inner flexible bladder and the inner surface of the outer flexible bladder.

6. The storage tank of claim 1 further comprising a sensor located in the space between the inner flexible bladder and the outer flexible bladder for detecting the inner liquid in the space between the inner flexible bladder and the outer flexible bladder.

7. The storage tank of claim 6, wherein the sensor is capable of measuring changes in resistivity or gravity of liquid.

8. The storage tank of claim 1 wherein the inner flexible bladder comprises a rupture disc therein having a design failure pressure such that when the pressure within the inner flexible bladder reaches the design failure pressure, the inner liquid will flow into the outer flexible bladder.

9. The storage tank of claim 1 wherein the removable cover of the protective enclosure comprises a hinged hatch.

10. The storage tank of claim 1 wherein the removable cover of the protective enclosure comprises a plurality of removable cover segments.

11. The storage tank of claim 1 wherein the removable cover of the protective enclosure comprises a material selected from the group consisting of fiberglass-reinforced epoxy, carbon fiber, steel and combinations thereof.

12. The storage tank of claim 1 wherein the protective enclosure has a plurality of compartments there within such that a plurality of liquids can be separately stored in the storage tank.

13. The storage tank of claim 1 wherein the protective enclosure comprises a material selected from the group consisting of fiberglass-reinforced epoxy, carbon fiber, steel and combinations thereof.

14. The storage tank of claim 1 wherein the protective enclosure is selected from the group consisting of a steel cage, a mesh cage and a combination thereof.

15. The storage tank of claim 1 wherein the protective enclosure has an internal pressure and an external pressure and wherein the protective enclosure is configured to allow for equalization of the internal and external pressures.

16. The storage tank of claim 1 wherein the protective enclosure is configured to be secured to the seafloor by a securing mechanism selected from the group consisting of suction piles, steel skirt piles and concrete anchor blocks.

17. A system for managing liquids in an offshore environment, comprising:

a. the storage tank of claim 1;

b. a first conduit connected to the inner flexible bladder liquid inlet of the storage tank of claim 1 for supplying the inner liquid from a topside location to the inner flexible bladder;

c. a second conduit connected to the inner flexible bladder liquid outlet; and d. a pump connected to the second conduit for pumping the inner liquid to a desired pressure for conveying the inner liquid within a pipeline to a desired location.

18. The system of claim 17, wherein the protective enclosure of the storage tank has a plurality of compartments, each compartment having a container therein and an inner flexible bladder liquid inlet and an inner flexible bladder liquid outlet; further comprising a subsea manifold comprising a number of conduits, each conduit corresponding to one of the plurality of compartments for supplying the inner liquid from a topside location to each of the inner flexible bladder liquid inlets.

19. A method for storing and managing liquids in an offshore environment, comprising:

a. supplying a first liquid to the inner flexible bladder of the storage tank of claim 1 located on a seafloor for storage therein;

b. supplying a second liquid to the outer flexible bladder of the storage tank of claim 1 for storage in the space between the inner flexible bladder and the outer flexible bladder;

c. flowing the first liquid through the inner flexible bladder liquid outlet to a conduit external to the protective enclosure of the storage tank for delivery to a desired subsea location; and d. circulating the second liquid in the space between the inner flexible bladder and the outer flexible bladder by operating a pump located in the outer liquid line between the outer flexible bladder liquid inlet and the outer flexible bladder liquid outlet.

20. The method of claim 19, wherein the step of supplying the first liquid to the inner flexible bladder filling comprises pumping the first liquid from a topside location using a pump while monitoring discharge pressure of the pump, further comprising controlling the discharge pressure of the pump to avoid overfilling the inner flexible bladder.

21. The method of claim 19, further comprising removing the container from within each of the at least one compartment of the protective enclosure on a desired frequency.

22. The method of claim 21, further comprising, prior to removing the container, partially inflating the inner flexible bladder and/or the outer flexible bladder to impart buoyancy to the container; and attaching the container to lifting equipment on a vessel or platform.

23. The method of claim 19, further comprising including a dye in the inner liquid in the inner flexible bladder such that in the event of a leak of the inner liquid from the inner flexible bladder, the dye can be detected in the space between the inner flexible bladder and the outer flexible bladder by ROV inspection.

* * * * *